US008702453B2

(12) United States Patent
Caveney et al.

(10) Patent No.: US 8,702,453 B2
(45) Date of Patent: Apr. 22, 2014

(54) MODULAR CABLE TERMINATION PLUG

(71) Applicant: Panduit Corp., Tinley Park, IL (US)

(72) Inventors: Jack E. Caveney, North Palm Beach, FL (US); Michael V. Doorhy, Mokena, IL (US); David A. Dylkiewicz, Lockport, IL (US); Jason J. German, Frankfort, IL (US); Nicholas G. Martino, Crete, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 13/630,429

(22) Filed: Sep. 28, 2012

(65) Prior Publication Data

US 2013/0052860 A1 Feb. 28, 2013

Related U.S. Application Data

(63) Continuation of application No. 13/277,401, filed on Oct. 20, 2011, now Pat. No. 8,277,260, which is a continuation of application No. 12/498,114, filed on Jul. 6, 2009, now Pat. No. 8,043,124, which is a continuation of application No. 12/120,900, filed on May 15, 2008, now Pat. No. 7,556,536, which is a continuation of application No. 11/619,697, filed on Jan. 4, 2007, now Pat. No. 7,374,458, which is a continuation of application No. 11/336,544, filed on Jan. 20, 2006, now Pat. No. 7,168,994, which is a continuation of application No. 10/947,742, filed on Sep. 23, 2004, now Pat. No. 7,018,241, which is a continuation of application No. 10/419,443, filed on Apr. 21, 2003, now Pat. No. 6,811,445.

(60) Provisional application No. 60/374,429, filed on Apr. 22, 2002.

(51) Int. Cl.
*H01R 24/00* (2011.01)

(52) U.S. Cl.
USPC ..... 439/676

(58) Field of Classification Search
USPC ..... 439/676, 607.01, 607.05, 417–418, 439/357, 425, 460, 941, 358
See application file for complete search history.

(56) References Cited

U.S. PATENT DOCUMENTS

| | | | |
|---|---|---|---|
| 4,466,878 | A | 8/1984 | DiNitto et al. |
| 4,601,530 | A | 7/1986 | Coldren et al. |
| 4,636,024 | A | 1/1987 | Yahata |
| 4,737,122 | A | 4/1988 | Dechelette |
| 5,071,219 | A | 12/1991 | Yurtin et al. |
| 5,203,717 | A | 4/1993 | Beck et al. |
| 5,211,576 | A | 5/1993 | Tonkiss et al. |
| 5,284,447 | A | 2/1994 | Kristiansen |

(Continued)

FOREIGN PATENT DOCUMENTS

| | | | |
|---|---|---|---|
| EP | 0811258 | B1 | 7/2002 |
| WO | 0033430 | A1 | 6/2000 |
| WO | 0074178 | A1 | 12/2000 |

*Primary Examiner* — Jean F Duverne
(74) *Attorney, Agent, or Firm* — Christopher S. Clancy; Christopher K. Marlow

(57) ABSTRACT

The invention is a modular cable termination plug having a conductor divider having an entrant barb and a plurality of divider channels, a load bar having a plurality of through holes and a plurality of slots, and a plurality of contact terminals. Additionally, the invention may include a housing, a strain relief collar and a strain relief boot.

4 Claims, 5 Drawing Sheets

(56) References Cited

U.S. PATENT DOCUMENTS

| | | | | | |
|---|---|---|---|---|---|
| 5,494,457 | A | | 2/1996 | Kumz | |
| 5,505,638 | A | | 4/1996 | Su et al. | |
| 5,562,479 | A | | 10/1996 | Pallas et al. | |
| 5,571,035 | A | | 11/1996 | Ferrill | |
| 5,573,423 | A | | 11/1996 | Lin et al. | |
| 5,628,647 | A | | 5/1997 | Rohrbaugh et al. | |
| 5,685,731 | A | | 11/1997 | Lin | |
| 5,685,736 | A | | 11/1997 | Lung | |
| 5,710,851 | A | | 1/1998 | Walter et al. | |
| 5,755,597 | A | * | 5/1998 | Panis et al. | 439/607.47 |
| 5,772,465 | A | * | 6/1998 | Hwang et al. | 439/418 |
| 5,830,005 | A | | 11/1998 | Watanabe | |
| 5,888,100 | A | * | 3/1999 | Bofill et al. | 439/676 |
| 5,899,770 | A | | 5/1999 | Ezawa | |
| 5,915,056 | A | | 6/1999 | Bradley et al. | |
| 5,967,801 | A | | 10/1999 | Martin et al. | |
| 5,971,812 | A | | 10/1999 | Martin | |
| 5,984,713 | A | | 11/1999 | Hsien | |
| 6,056,586 | A | | 5/2000 | Lin | |
| 6,077,122 | A | * | 6/2000 | Elkhatib et al. | 439/607.05 |
| 6,080,007 | A | | 6/2000 | Dupuis et al. | |
| 6,083,052 | A | | 7/2000 | Adams et al. | |
| 6,099,345 | A | | 8/2000 | Milner et al. | |
| 6,113,400 | A | | 9/2000 | Martin et al. | |
| 6,238,235 | B1 | | 5/2001 | Shavit et al. | |
| 6,250,949 | B1 | | 6/2001 | Lin | |
| 6,257,914 | B1 | * | 7/2001 | Comerci et al. | 439/357 |
| 6,280,232 | B1 | | 8/2001 | Beecher et al. | |
| 6,322,386 | B1 | | 11/2001 | Tharp et al. | |
| 6,325,660 | B1 | | 12/2001 | Diaz et al. | |
| 6,354,872 | B1 | | 3/2002 | Lilienthal, II et al. | |
| 6,357,933 | B1 | | 3/2002 | Bradley et al. | |
| 6,368,144 | B2 | | 4/2002 | Viklund | |
| 6,409,544 | B1 | | 6/2002 | Wu | |
| 6,506,077 | B2 | | 1/2003 | Nagel | |
| 6,582,255 | B2 | | 6/2003 | Simmons et al. | |
| 6,599,148 | B1 | | 7/2003 | Jensen et al. | |
| 6,729,901 | B2 | | 5/2004 | Aekins | |
| 6,783,402 | B2 | | 8/2004 | Chen | |
| 6,786,757 | B2 | | 9/2004 | Pocrass | |
| 2001/0016102 | A1 | | 8/2001 | DeMarchi | |
| 2002/0146924 | A1 | | 10/2002 | Simmons et al. | |
| 2005/0063152 | A1 | | 3/2005 | Chen et al. | |

* cited by examiner

MODULAR CABLE TERMINATION PLUG

CROSS-REFERENCE TO RELATED APPLICATIONS

This application is a continuation of U.S. patent application Ser. No. 13/277,401, filed Oct. 20, 2011; which is a continuation of U.S. patent application Ser. No. 12/498,114, filed Jul. 6, 2009, which issued as U.S. Pat. No. 8,043,124 on Oct. 25, 2011; which is a continuation of U.S. patent application Ser. No. 12/120,900, filed May 15, 2008, which issued as U.S. Pat. No. 7,556,536 on Jul. 7, 2009; which is a continuation of U.S. patent application Ser. No. 11/619,697, filed Jan. 4, 2007, which issued as U.S. Pat. No. 7,374,458 on May 20, 2008; which is a continuation of U.S. patent application Ser. No. 11/336,544, filed Jan. 20, 2006, which issued as U.S. Pat. No. 7,168,994 on Jan. 30, 2007; which is a continuation of U.S. patent application Ser. No. 10/947,742, filed Sep. 23, 2004, which issued as U.S. Pat. No. 7,018,241 on Mar. 28, 2006; which is a continuation of U.S. patent application Ser. No. 10/419,443, filed Apr. 21, 2003, which issued as U.S. Pat. No. 6,811,445 on Nov. 2, 2006; which claims the benefit of U.S. Provisional Application No. 60/374,429, filed Apr. 22, 2002. All of these applications are incorporated herein in their entireties.

FIELD OF INVENTION

The present invention relates generally to the field of modular plugs for terminating cables. More particularly, it relates to an improved plug for terminating communication cables having a plurality of twisted signal pairs of conductors and controlling the positions of the untwisted conductors in order to reduce near-end crosstalk.

BACKGROUND OF THE INVENTION

Communications networks generally transmit data at a high frequency over cables having a plurality of twisted signal pairs of conductors. For example, according to currently accepted performance standards, Category 5 products operate at frequencies up to 100 MHz and Category 6 products operate at frequencies up to 250 MHz over Unshielded Twisted Pair (UTP) cable that contains eight (8) individual conductors arranged as four (4) twist pairs. When data is transmitted via an alternating current in a typical telecommunication application at such high frequencies, each individual conductor and each signal pair creates an electromagnetic field that can interfere with signals on adjacent conductors and adjacent signal pairs. This undesirable coupling of electromagnetic energy between adjacent conductor pairs, referred to as crosstalk, causes many communications problems in networks.

Crosstalk is effectively controlled within communication cables through the use of twisted pairs of conductors. Twisting a signal pair of conductors causes the electromagnetic fields around the wires to cancel out, leaving virtually no external field to transmit signals to nearby cable pairs. In contrast, Near End Crosstalk (NEXT), the crosstalk that occurs when connectors are attached to twisted pair cables, is much more difficult to control. Since twisted signal pairs must be untwisted into individual conductors in order to attach a connector, high levels of NEXT are introduced when portions of transmitted signals within the connector are electromagnetically coupled back into received signals.

In efforts to control NEXT, a wide variety of modular plugs have been developed for terminating communications cables that contain twisted signal pairs of conductors. As communication technology advances, however, and allows transmission at higher and higher frequencies, the modular plugs known in the prior art are no longer capable of maintaining NEXT levels within the ranges specified in widely accepted national performance standards. For Category 6 products, for example, the Commercial Building Telecommunications Wiring Standard (ANSI/TIA/EIA-568) specifies a de-embedded NEXT test plug range which all patch cord plugs should meet to ensure interoperable Cat 6 performance. In order to satisfy TIA/EIA 568B-2.1, patch cord plugs must be designed with low NEXT variability centered within the specified de-embedded NEXT test plug range. In standard plug designs, however, pair-to-pair distortion, twist rate, and individual conductor positions are not strictly controlled. Hence, large variations of NEXT performance occur. Prior art modular plug designs also cause increased de-embedded NEXT variability by utilizing strain relief components that consist of a latching bar that pinches the cable jacket, prohibiting cable movement within the plug housing. In order to generate sufficient retention force, these bar style strain relief components significantly deform the cable jacket and the twisted pair conductors within the jacket. This pinching deformation causes distortion and displacement of twisted pairs of conductors that in turn causes increased de-embedded NEXT variability.

Accordingly, there is a demand for an improved modular cable termination plug.

SUMMARY OF THE INVENTION

The present invention overcomes the deficiencies of the prior art by providing an improved modular cable termination plug. The improved modular cable termination plug of the claimed invention utilizes mechanical features that will control the twist rate, un-twisted length, and position of individual conductors as well as twisted pairs of conductors within a cable and ensure repeatable placement of the conductors from the undisturbed cable to the point of termination. Accordingly, in comparison to the modular cable termination plugs available in the prior art, the claimed invention is more versatile and provides reduced NEXT variability and enhanced performance.

In accordance with the present invention, the improved modular cable termination plug comprises a conductor divider having an entrant barb and a plurality of conductor divider channels, a load bar having a plurality of through holes, and a plurality of contact terminals of alternating heights. In one embodiment of the invention, the conductor divider and the load bar hold conductors in three separate horizontal planes in order to minimize crosstalk between adjacent signal pairs of conductors. One embodiment of the present invention also provides for a housing and a plurality of slots in the load bar that are adapted to receive the plurality of contact terminals. The integral slots in the load bar provide an advantage over the prior art by reducing the overall length of untwisted cable within a housing.

It is another feature of the invention to provide a cable strain relief. In one embodiment, a strain relief collar secures the load bar, conductor divider, and cable within a housing. In another embodiment of the claimed invention, a strain relief boot protects the bend radius of the cable.

It is yet another feature of the invention to provide a method of separating and arranging signal pairs of conductors in order to minimize the crosstalk within a modular connector plug. According to the method, untwisted signal pairs are separated and arranged into three separate planes, and individual conductors are separated and arranged in three separate planes and are terminated by contact terminals having varying heights.

These and other features and advantages of the present invention will be apparent to those skilled in the art upon review of the following detailed description of the drawings and preferred embodiments.

DETAILED DESCRIPTION OF PREFERRED EMBODIMENTS

Figure 1:
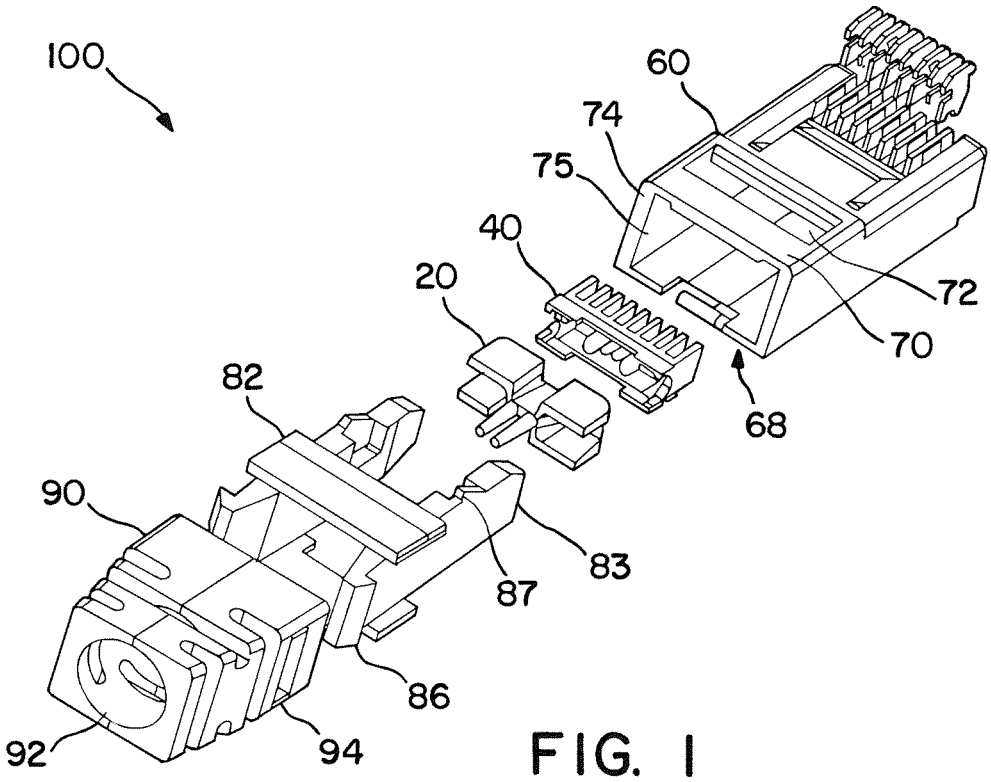
FIG. 1 is an exploded perspective view of a modular plug assembly in accordance with the claimed invention.
Figure 1A:
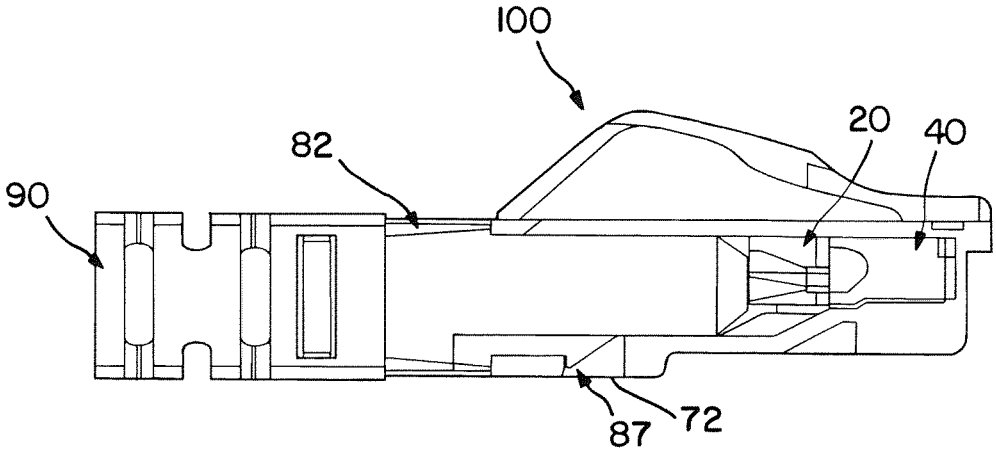
FIG. 1A is a cross sectional view of a modular plug assembly in accordance with the claimed invention.
Figure 2A:
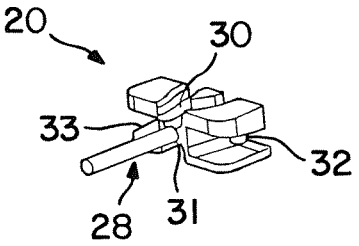
FIG. 2A is a perspective view of a first embodiment of a conductor divider in accordance with the claimed invention.
Figure 2B:
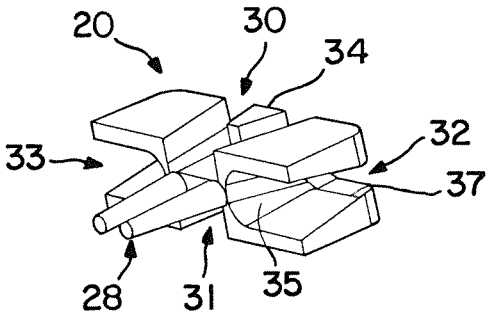
FIG. 2B is a perspective view of a second embodiment of a conductor divider in accordance with the claimed invention.
Figure 3:
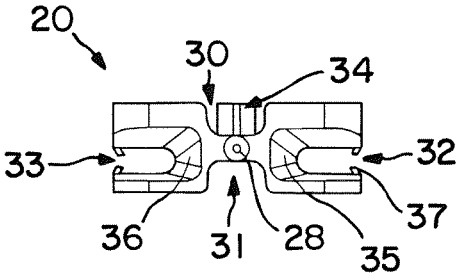
FIG. 3 is a rear view of a conductor divider in accordance with the claimed invention.

Referring now to the drawings, FIG. 1 shows an exploded perspective view of a modular plug assembly 100 in accordance with the claimed invention. In the preferred embodiment of the claimed invention, the plug assembly includes a strain relief boot 90, a strain relief collar 82, a conductor divider 20, a load bar 40, and a housing 60. The preferred modular plug 100 is depicted in an assembled state in the cross sectional view shown in FIG. 1A. As shown in FIG. 1A, the conductor divider 20 and the load bar 40 are designed to fit within the internal cavity 68 of the plug housing 60. The conductor divider 20 and the load bar 40 are secured in their proper location within the plug housing 60 by the walls 83 of the strain relief collar 82. In an assembled state, movement of the conductor divider 20, the load bar 40, and the strain relief collar 82 is preferably minimized through the use of an integrated snap. A horizontal latch tab 87 on the strain relief collar 82 engages against the edge of a pocket 72 in the lower surface 70 of the plug housing 60. In a similar manner, each wall 83 of the strain relief collar 82 has a vertical latch tab 86 that engages against the edges of pockets 94 in the strain relief boot 90 in order to complete the preferred assembly.

The conductor divider 20 of the claimed modular plug assembly is shown in detail in FIGS. 2-5. The conductor divider 20 is comprised of an entrant barb 28 and a plurality of divider channels 30, 31, 32, 33. The entrant barb 28 is designed to be fully inserted into a communications cable 10 and thereby greatly minimize the traditional transition region that is present in prior art plugs between a non-distorted cable and any cable organizing device. It is well known to those skilled in the art that crosstalk can be reduced by limiting the length of manipulated untwisted cable. Accordingly, by substantially reducing the transition region between the cable 10 and the conductor divider 20, the present invention effectively eliminates a potential source of crosstalk within the modular connector 100 that is present in prior art designs. The entrant barb 28 is preferably in the form of a double post, as shown in FIG. 2B, since the double post design can be used in connection with cables 10 that have an internal spline or with splineless cables. When used with a cable 10 having an internal spline, each post in the double post design fits into a corner of the cable spline flush to the end of the cable 10. This retention eases termination by allowing an installer to free his grasp of the conductor divider 20 while untwisting signal pairs of conductors and seating the signal pairs 12 in the divider channels 30, 31, 32, 33. While the entrant barb 28 having a double post is preferred, one skilled in the art should recognize that a single post entrant barb 28 as shown in FIG. 2A, or any number of other designs could be effectively used according to the claimed invention.

Figure 5:
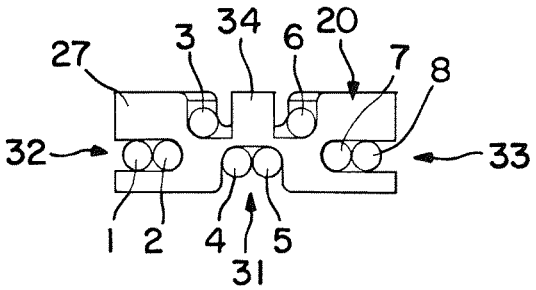
FIG. 5 is a front view of a conductor divider with conductors in each divider channel in accordance with the claimed invention.
Figure 4A:
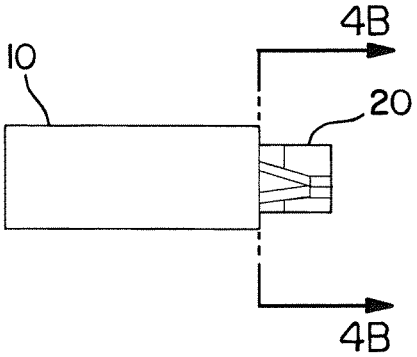
FIG. 4A is a side view of a conductor divider and cable in accordance with the claimed invention.
Figure 4B:
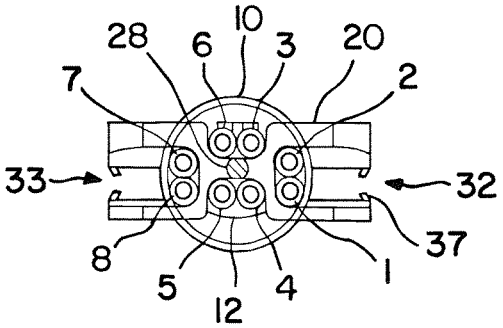
FIG. 4B is a cross sectional view of the conductor divider of FIG. 4A taken along line 4B-4B.
Figure 6:
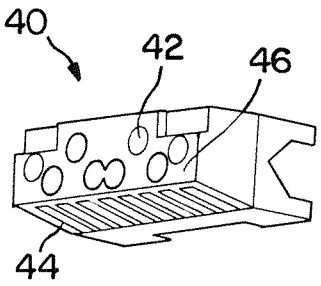
FIG. 6 is a front perspective view of a first embodiment of a load bar in accordance with the claimed invention.
Figure 7:
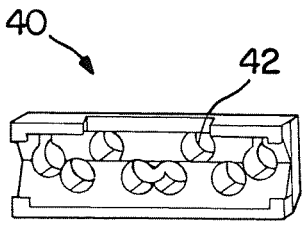
FIG. 7 is a rear perspective view of a first embodiment of a load bar in accordance with the claimed invention.

The conductor divider 20 shown in FIGS. 2-5 also has a plurality of divider channels 30, 31, 32, 33 for separating and arranging the signal pairs 12 of conductors in a communications cable 10. Since the preferred embodiment of the claimed invention is a Category 6 modular plug that terminates an Unshielded Twisted Pair (UTP) cable that contains eight (8) individual conductors arranged as four (4) twist pairs, the preferred conductor divider 20 has four divider channels 30, 31, 32, 33. As shown in FIGS. 4 and 5, each divider channel 30, 31, 32, 33 is preferably designed to grip and hold one untwisted conductor pair. In the preferred embodiment of the claimed plug assembly 100, the upper divider channel 30 features a tapered split channel divider 34, and the side divider channels 32, 33 have tapered side walls 35, 36 and retention bumps 37, all of which help secure conductor signal pairs in an untwisted state within the channels.

The load bar 40 of the claimed modular plug 100 is shown in detail in FIGS. 6-10. The load bar 40 preferably has a plurality of through holes 42 that are used to separate and arrange each individual conductor 1, 2, 3, 4, 5, 6, 7, 8 of the cable 10. In the preferred embodiment, the through holes 42 holds each individual conductor in one of three planes in order to control NEXT. The load bar 40 also has integral slots 44 aligned with each through hole 42 that are adapted to receive a contact terminal 50.

Figure 11:
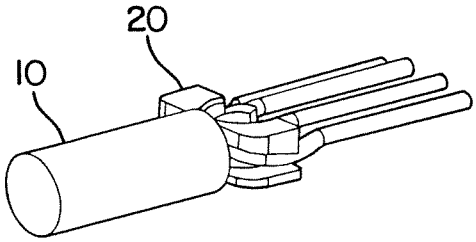
FIG. 11 is a perspective view of a conductor divider and cable in accordance with the claimed invention.

The modular plug 100 of the claimed invention can be easily assembled in the field. Referring to FIG. 1 and FIG. 11, a cable 10 is inserted through the cable clearance hole 92 of the strain relief boot 90 and through the strain relief collar 82. The twisted pairs of conductors are untwisted, and each untwisted signal pair 12 is placed into one of the plurality of divider channels 30, 31, 32, 33 on the conductor divider 20.

Since the conductor divider 20 does not have a designated top or bottom surface, the conductor divider 20 can be utilized for both ends of a cable 10 by flipping the conductor divider 20 over to match the orientation of the cable. Accordingly, termination of cables 10 in the field is easier than with prior art designs since the conductor divider 20 can be installed depending on the cable lay and signal pair 12 disturbance can be minimized. In the preferred embodiment shown in the figures, the signal pair 12 of conductors 3 and 6 are placed in the upper divider channel 30, the signal pair 12 of conductors 4 and 5 are placed in the lower divider channel 31, and the signal pairs 12 of conductors 1 and 2 and 7 and 8 are placed in side divider channels 32, 33. The retention bumps 37 on the side divider channels 32, 33 help speed the process of termination by holding the signal pairs 12 in place and allowing the installer to focus on seating the next signal pair 12.

When the signal pairs 12 are placed in a divider channel, the entrant barb 28 of the conductor divider 20 is fully inserted into the cable 10 as shown in FIG. 11, thereby eliminating any transition region between the cable 10 and the divider channels 30, 31, 32, 33. The alignment of the signal pairs 12 within the channel dividers 30, 31, 32, 33 on the installed conductor divider 20 is shown in FIGS. 4 and 5. As shown in FIG. 4, as the signal pairs 12 emerge from the cable 10, the signal pair 12 for conductors 3 and 6 and for conductors 4 and 5 are held in a parallel, horizontal arrangement. This arrangement of signal pairs 12 is maintained throughout the divider channels 30, 31, except that in the preferred embodiment shown in FIG. 5, the signal pair 12 in the upper divider channel 30 is separated by a tapered divider 34. Referring back to FIG. 4, it can be seen that the signal pairs 12 for conductors 1 and 2 and for conductors 7 and 8 will initially be held in a vertical arrangement in the side divider channels 32, 33. Within the side divider channels 32, 33, the tapered side walls 35, 36 will gently reposition and secure the signal pairs 12 in a fixed horizontal arrangement at the front surface 27 of the conductor divider 20, as shown in FIG. 5.

For the purposes of reducing crosstalk within a connector, securing untwisted signal pairs 12 in a fixed position with the claimed invention offers a distinct advantage over prior art designs that do not control the precise positions of untwisted signal pairs 12 or individual conductors. By eliminating the transition area between the cable and the conductor divider channels and by separating and controlling the conductor signal pairs 12 while the conductors 1, 2, 3, 4, 5, 6, 7, 8 transition from the circular state within the cable 10 to the planar state within the modular plug 100, NEXT is reduced in the claimed modular plug. NEXT can be even further reduced by arranging the conductor signal pairs 12 in different planes on the front surface 27 of the conductor divider 20. Preferably, the conductors are arranged horizontally in three separate planes as shown in FIG. 5, as a tri-level conductor divider 20 minimizes NEXT between signal pairs 12 of conductors 3,6 and conductors 4,5, between signal pairs 12 of conductors 3,6 and conductors 1,2, and between signal pairs 12 of conductors 3,6 and conductors 7,8. One skilled in the art will also recognize that the positioning and geometry of the divider channels 30, 31, 32, 33 can be modified to tune NEXT variability between signal pairs 12 within accepted levels. For example, the side divider channels 32, 33 can be raised or lowered, the separation between the upper channel divider 30 and the lower channel divider 31 can be increased or decreased, or the tapered divider 34 in the upper channel divider 30 could be wider or narrower.

Figure 8:
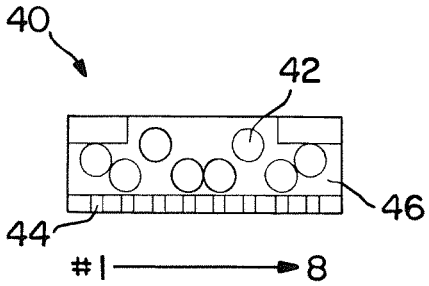
FIG. 8 is a front view of a first embodiment of a load bar in accordance with the claimed invention.
Figure 9:
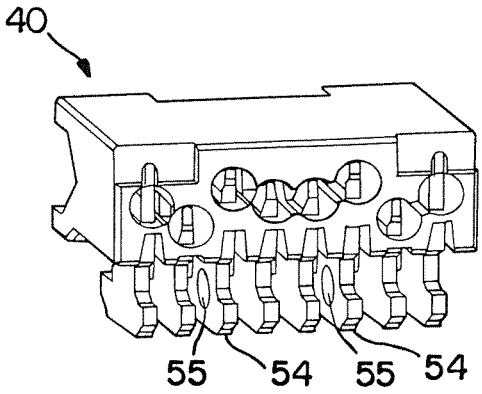
FIG. 9 is a front perspective view of a second embodiment of a load bar and IDC contacts in accordance with the claimed invention.
Figure 10A:
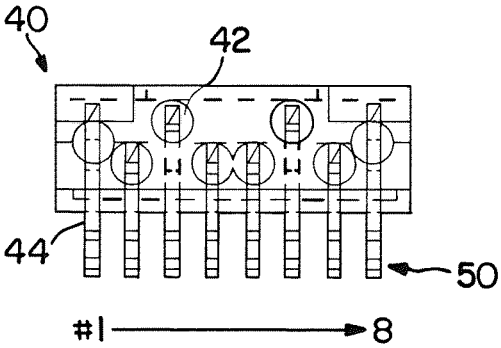
FIG. 10A is a front view of a first embodiment of a load bar and IDC contacts in accordance with the claimed invention.
Figure 10B:
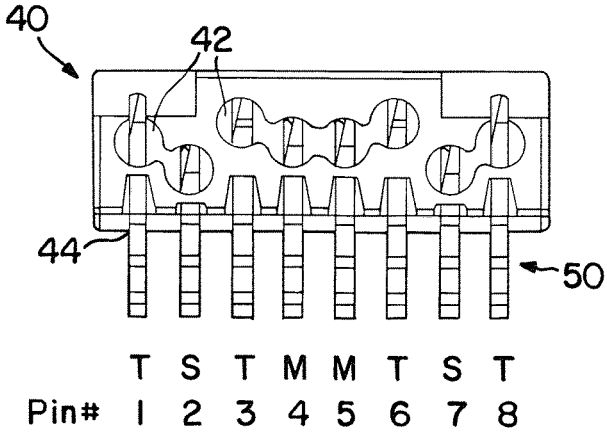
FIG. 10B is a front view of a second embodiment of a load bar and IDC contacts in accordance with the claimed invention.
Figure 14:
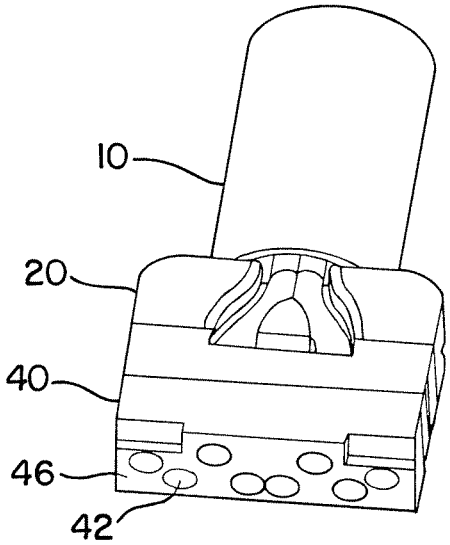
FIG. 14 is a perspective view of a conductor divider, load bar and cable in accordance with the claimed invention.
Figure 12:
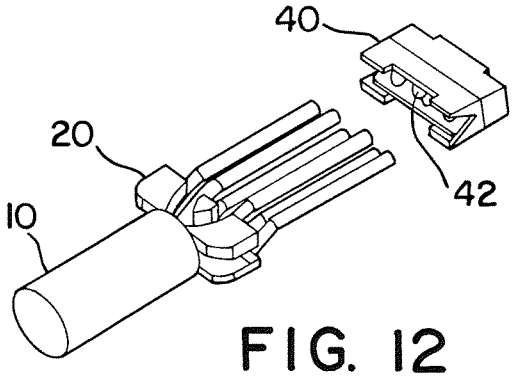
FIG. 12 is an exploded perspective view of a conductor divider, load bar and cable in accordance with the claimed invention.
Figure 13:
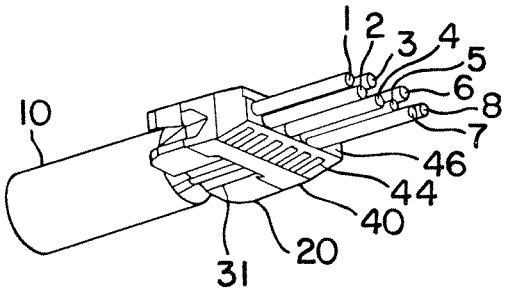
FIG. 13 is a perspective view of a conductor divider, load bar and cable in accordance with the claimed invention.

Referring now to FIGS. 12, 13 and 14, the load bar 40 is installed following the conductor divider 20. As shown in FIG. 12, each signal pair 12 held by the conductor divider 20 is separated into individual conductors 1, 2, 3, 4, 5, 6, 7, 8, and each conductor is inserted through a through hole 42 in the load bar 40. In order to comply with nationally recognized standards, the conductors 1, 2, 3, 4, 5, 6, 7, 8 are arranged in sequential order as shown in FIGS. 8, 10A and 10B. The load bar 40 also preferably holds the conductors in a staggered alignment and in three horizontal planes as shown in FIGS. 6-10. In the preferred embodiment, the staggered placement of conductors 1, 2, 3, 4, 5, 6, 7, 8 in the load bar 40 reduces NEXT by balancing electromagnetic energy transmitted between signal pairs 12. For example, by placing the through hole 42 for conductor 2 vertically below the through holes 42 for conductor 1 and conductor 3, conductor 3 will induce a more even magnitude of electromagnetic energy on conductor 1 relative to the horizontally adjacent conductor 2. Further, one skilled in the art should recognize that by varying the placement of the individual conductors 1, 2, 3, 4, 5, 6, 7, 8 within the load bar 40, NEXT variability between signal pairs 12 can be tuned within accepted levels. By comparing the embodiment of the load bar 40 in FIGS. 6, 7, 8, and 10A to the embodiment of the load bar 40 in FIGS. 9 and 10B, an example of how the placement of individual conductors can be varied within the load bar 40 can be seen. Specifically, the distance between conductors 3 and 6 and conductors 4 and 5 can be adjusted in order to tune the NEXT performance of the modular plug 100.

In order to minimize NEXT, the load bar 40 is preferably installed adjacent to the conductor divider 20 as shown in FIG. 13 in order to minimize the length of the untwisted conductors 1, 2, 3, 4, 5, 6, 7, 8. The overall length of the claimed modular plug is also minimized through the use of slots 44 that are integral to the load bar 40. The integral slots 44 allow the claimed invention to utilize a more compact design than those known in the prior art and thereby enhance the overall performance of the plug. Once the load bar 40 is positioned, the excess cable shown in FIG. 13 can be trimmed at the cut off face 46 of the load bar 40, resulting in the complete subassembly shown in FIG. 14.

Figure 15:
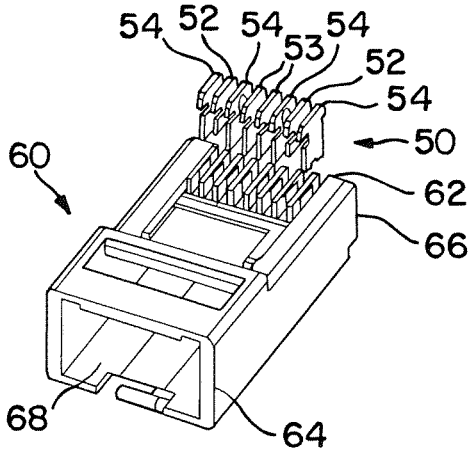
FIG. 15 is an exploded perspective view of the housing and the IDC contacts in accordance with the claimed invention.

In order to complete the assembly of the modular plug 100, the subassembly shown in FIG. 14 can be inserted into the cavity 68 of the housing 60 as shown in FIGS. 1A and 15. The load bar 40, conductor divider 20 and cable 10 are preferably secured within the cavity 68 of the housing 60 with the strain relief collar 82. The walls 83 of the strain relief collar 82, which has been previously installed on the cable 10, slide into the cavity 68 of the housing 60 until the latch tab 87 engages against the edge of the pocket 72 in the lower surface 70 of the housing 60. The engaged strain relief collar 82 exerts a force against the conductor divider 20 within the cavity 68 of the housing 60, thereby ensuring the proper positioning of the conductor divider 20 and the load bar 40 within the housing 60 and preventing the conductor divider 20 and the load bar 40 from traveling back and out of the housing 60.

Figure 16:
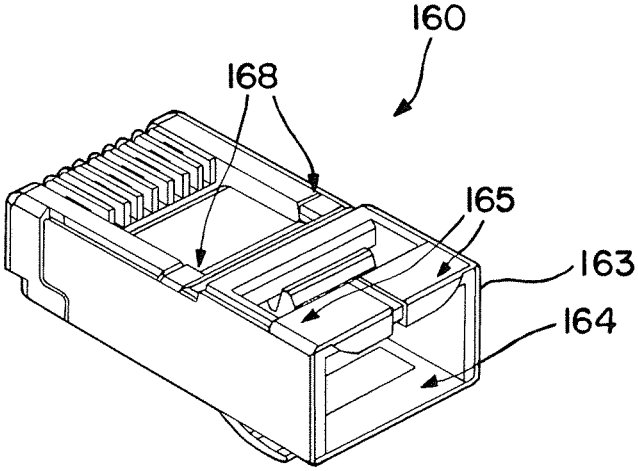
FIG. 16 is a perspective view of an alternative embodiment of a housing in accordance with the claimed invention.

In embodiments where a shielded cable is used, a shielded plug housing 160 is required in order to make an electrical ground connection between the cable 10 and the mating housing 160. As shown in FIG. 16, the shielded plug housing 160 has an electromagnetic interference shield 163, a pair of contact tabs 165, and a pair of support tabs 168. In order to complete assembly of a shielded modular plug, the ground braid of a cable should be folded back onto the cable jacket. Then, when the subassembly shown in FIG. 14 is inserted into the cavity 68 of the shielded housing 160, the ground braid of the cable will contact the upper surface 164 of the shield 163 and the pair of contact tabs 165, forming an electrical ground connection path through the cable and the shield 163.

Figure 17:
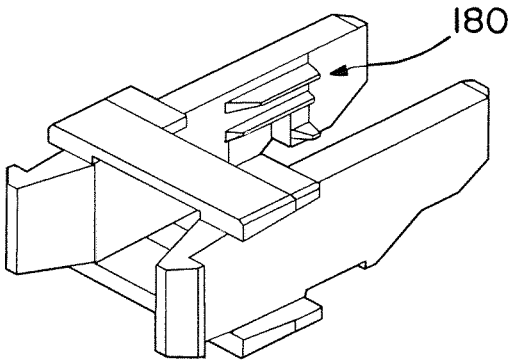
FIG. 17 is a perspective view of one embodiment of a strain relief collar in accordance with the claimed invention.

In addition to securing the conductor divider 20 and load bar 40, the strain relief collar 82 also uses a combination of normal and shear forces to secure the cable 10. In the preferred embodiment of the claimed invention, when the stain relief collar 82 is installed over a cable 10, the walls 83 of the strain relief collar 82 deflect outwardly. This outward deflection of the walls 83 of the strain relief collar 82 creates an interference fit between the exterior surface of the walls 83 of the strain relief collar 82 and the interior walls 75 of the cavity 68 of the housing 60. Preferably, as the walls 83 of the strain relief collar 82 are installed into the cavity 68 of the housing 60, the interference fit causes the walls 83 to deflect inward, resulting in a press fit that generates a normal force on the cable 10 along the entire length of the wall 83 and a shear force at the interior edge of the wall 83. In some embodiments, these forces may also be enhanced by the placement of cable retention barbs 180 on the inside surface of the walls 83, as shown in FIG. 17. With or without the barbs 180, however, these forces provide superior retention of the cable 10 without the distortion and displacement of twisted pairs of conductors within the cable 10 that occurs with the latching bar strain relief features that are well known in the prior art. Accordingly, the present invention also provides enhanced control over NEXT variability.

After the strain relief collar 82 is engaged in the cavity 68 of the housing 60, the strain relief boot 90, also previously installed on the cable 10, can be secured onto the modular plug assembly 100. The strain relief boot 90 slides over the walls 83 of the strain relief collar 82, and the latch tabs 86 are preferably engaged against the edges of the pockets 94 in the strain relief boot 90. The boot, which is preferably made of a rubberized material, ensures that the minimum bend radius of the cable 10 leaving the modular plug 100 is maintained.

Finally, electrical termination for the modular plug assembly 100 is accomplished by inserting a plurality of contact terminals, preferably insulation piercing contacts (IPCs) 50, through the slots 62 in the housing 60 which are aligned with the slots 44 in the load bar 40. As shown in FIGS. 1, 9, 10A and 10B, different sizes of contact terminals 50 are used to terminate the connections in the plug assembly 100. Two or three different sizes of contact terminals may be used, but tall IPCs 54, Medium IPCs 53, and short IPCs 52 are preferably alternated and aligned with respective conductors 1, 2, 3, 4, 5, 6, 7, 8 that are held in a staggered relationship in the load bar 40. It is known in the art that an alternating IPC pattern minimizes NEXT by balancing coupled electromagnetic energy that is transmitted between contacts, but the unique arrangement of staggered conductors and alternating IPCs disclosed in FIGS. 6-10 and 15 maximizes this effect. In the preferred embodiment, placing a short contact pin 52 aligned with conductor 2 between two tall contact pins 54 aligned with conductor 1 and conductor 3 compensates conductor 3 to conductor 2 coupling with conductor 3 to conductor 1 coupling. As a result, despite the tall contact 54 for conductor 1 being twice the distance from the contact for conductor 3 as from the contact for conductor 2, the extra coupling generated by the larger surface area of the tall contact 54 for conductor 1 counterbalances the relatively large amount of coupling induced upon the closer short contact 52 for conductor 2. In addition, NEXT can be even further minimized in the preferred embodiment by placing a hole 55 in the tall contact terminal 54 corresponding to conductor 3 and thereby reducing the surface area of the contact terminal. The reduced surface area has the effect of reducing the coupling between the contact terminals 50 for conductors 3 and 2 while maintaining the coupling between the contact terminals 50 for conductors 3 and 1.

It should be understood that the illustrated embodiments are exemplary only and should not be taken as limiting the scope of the present invention. The claims should not be read as limited to the order or elements unless stated to that effect. Therefore, all embodiments that come within the scope and spirit of the following claims and equivalents thereto are claimed as the invention.

We claim:

1. A modular plug for terminating a cable having a plurality of conductors held therein comprising:

a housing;

a strain relief collar configured to be inserted into the housing and to enclose the cable; the strain relief collar comprising a pair of opposing sidewalls, the sidewalls being connected by a top and bottom strip, the strain relief collar being configured to apply a compressive force against the cable via the opposing sidewalls.

2. The plug of claim 1 further comprising cable retention barbs on inner surfaces of the sidewalls.

3. The plug of claim 1 further comprising a strain relief boot.

4. A strain relief collar for use in a modular plug having a housing, a strain relief boot, and a cable with a plurality of twisted signal pairs, the strain relief collar comprising:

a pair of opposing sidewalls, the sidewalls being connected by a top and bottom strip; and vertical latch tabs located on the end of the sidewalls, the vertical latch tabs configured to engage pockets on the strain relief boot in order to secure the strain relief collar to the strain relief boot, the strain relief collar being configured to enclose the cable and apply a compressive force against the cable via the opposing sidewalls and further configured to be inserted into the housing; horizontal latch tabs on upper edges of the sidewalls of the strain relief collar, the horizontal latch tabs configured to engage edges of a pocket located on the housing and secure the strain relief collar within the housing.

* * * * *

UNITED STATES PATENT AND TRADEMARK OFFICE

CERTIFICATE OF CORRECTION

PATENT NO. : 8,702,453 B2
APPLICATION NO. : 13/630429
DATED : April 22, 2014
INVENTOR(S) : Jack E. Caveney et al.

It is certified that error appears in the above-identified patent and that said Letters Patent is hereby corrected as shown below:

In the Claims

Column 8, line 35, claim 1 which reads "...force against the cable via the opposing sidewalls." should read "... force against the cable via the opposing sidewalls, horizontal latch tabs on upper edges of the sidewalls of the strain relief collar, the horizontal latch tabs configured to engage edges of a housing pocket located in the housing to secure the strain relief collar within the housing."

Signed and Sealed this
Twenty-fifth Day of August, 2015

Michelle K. Lee

Michelle K. Lee
*Director of the United States Patent and Trademark Office*